US006135065A

United States Patent [19]

Weathers et al.

[11] Patent Number: 6,135,065

[45] Date of Patent: Oct. 24, 2000

[54] COOLING SYSTEM FOR A MACHINE

[75] Inventors: Kenneth E. Weathers, Aurora; Paul A. Dicke, Peoria; Jeffry A. Butler, Aurora, all of Ill.

[73] Assignee: Caterpillar Inc., Peoria, Ill.

[21] Appl. No.: 09/289,261

[22] Filed: Apr. 9, 1999

[51] Int. Cl.[7] ..... F01P 1/06

[52] U.S. Cl. ..... 123/41.31; 123/41.33

[58] Field of Search ..... 123/41.31, 41.33

[56] References Cited

U.S. PATENT DOCUMENTS

| | | | |
|---|---|---|---|
| 1,992,568 | 2/1935 | Connor . | |
| 2,541,227 | 2/1951 | Findley . | |
| 4,061,187 | 12/1977 | Rajusekaran et al. | 165/107 |
| 4,362,131 | 12/1982 | Mason et al. | 123/41.1 |
| 4,535,729 | 8/1985 | Faylor | 123/41.1 |
| 4,915,192 | 4/1990 | Hayashida et al. | 180/309 |
| 4,961,404 | 10/1990 | Itakura et al. | 123/41.31 |
| 5,316,106 | 5/1994 | Baedke et al. | 184/6.12 |
| 5,353,757 | 10/1994 | Susa et al. | 123/41.31 |
| 5,537,956 | 7/1996 | Rennfeld et al. | 123/41.31 |
| 5,669,338 | 9/1997 | Pribble et al. | 123/41.31 |
| 5,910,099 | 6/1999 | Jordan, Jr. et al. | 123/41.31 |

FOREIGN PATENT DOCUMENTS

3116595A1 11/1982 Germany .

*Primary Examiner*—John Kwon
*Attorney, Agent, or Firm*—David M. Masterson

[57] ABSTRACT

It is common in the operation of a construction machine to utilize several different functional modes. Some modes may predominately utilize the braking systems of the machine will other modes may predominately utilize the engine to operate the various implements. In either case, supplemental cooling of these systems is often desirable. The present invention provides a cooling system wherein each axle assembly has a cooling system in addition to the conventional cooling system for the engine. All the cooling systems communicate with a common heat exchanger. A pump is provided to circulate oil from the axle assemblies, as well as coolant from the engine through the heat exchanger to reduce the temperature of one of the fluids. A pair of sensors are engaged with the engine and the axles to selective actuate a clutch member to provide driving engagement between the engine and the pump in response to either component reaching a preselected temperature.

15 Claims, 1 Drawing Sheet

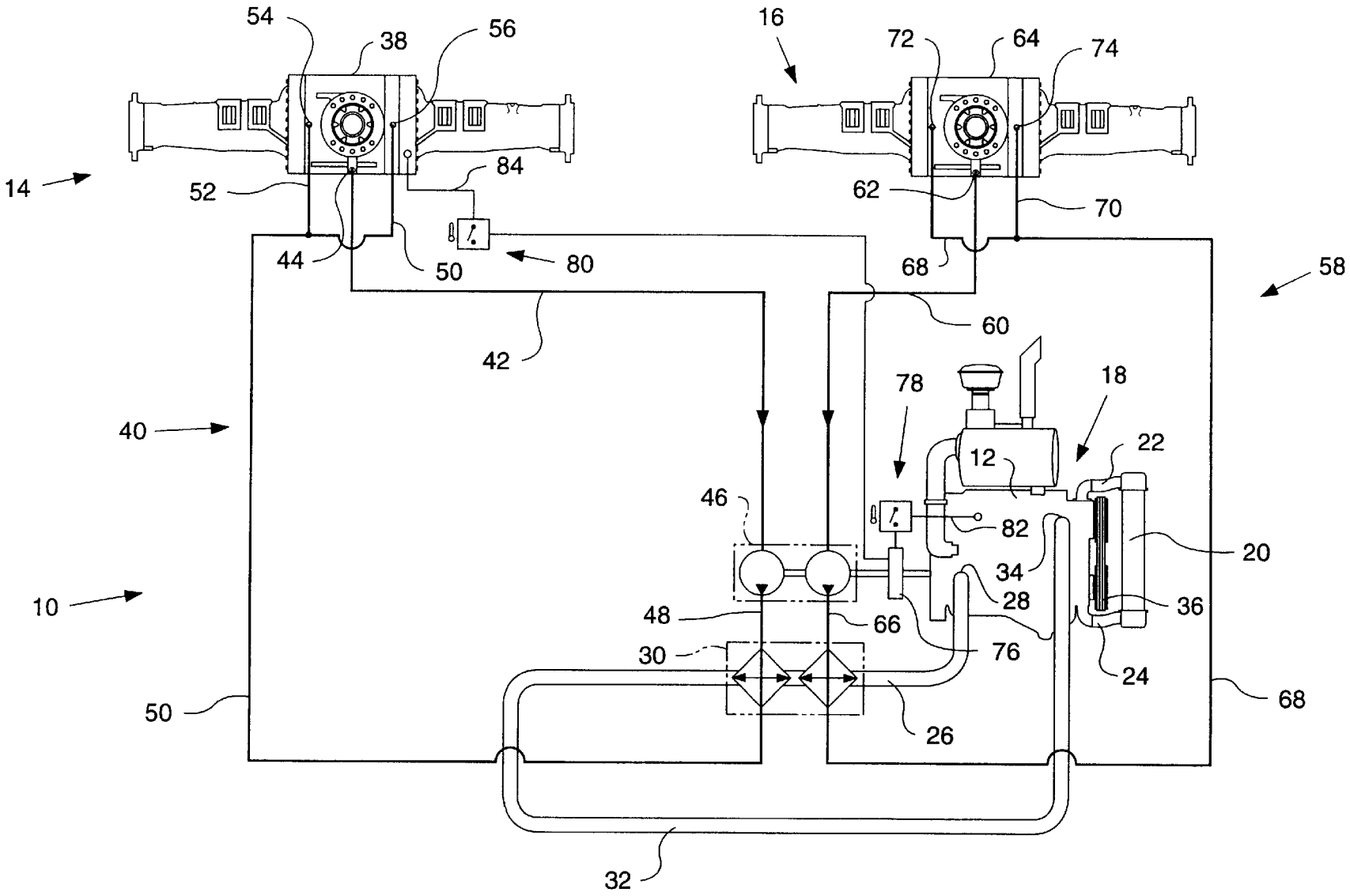
58
68
20
36
22
24
18
74
70
64
82
34
28
76
12
60
26
72
68
62
78
66
16
46
48
30
32
80
42
56
84
50
38
44
54
52
40
50
14
10

COOLING SYSTEM FOR A MACHINE

TECHNICAL FIELD

This invention relates to a cooling system and more particularly to a cooling system that will reduce the temperature of the oil within an axle assembly or the temperature of the engine coolant depending upon the mode of machine operation.

BACKGROUND ART

In the operation of a construction machine, it is quite common for the machine to experience several different work modes. In a wheel loader for example, various tasks include truck loading, load and carry and other more specialized tasks. In truck load and carry operations for example, there is an abundance of machine movement in which the machine will attain relatively high speeds as it carries a load from one place to another. The braking application in both the front and rear axles is severe since they are required to bring the machine to a stop after attaining these high speeds. This frequently causes the brakes, and the oil within the axle housings in which the brakes are located, heat up to excessive temperatures. In other instances such as truck loading or instances where there is a high degree of implement use without much machine travel, the brakes are not utilized much and the axle temperature is not a concern. However, in these situations, enhancement of the engine's cooling system would be very beneficial to ensure that the temperature of the engine does not become excessive.

In both instances set forth above, heat is a by-product of the different operations that is known to cause excessive wear and potentially premature failure of various components. Where excessive engine heat is concerned several common remedies have been known to work quite well. They include enlarged cooling system capacities or additional cooling mediums within the typical cooling system. With respect to the heat build up experienced in axle assemblies, several methods have also been employed to reduce heat. Typically, some type of system is employed to circulate the oil within the axle housings through a air-to-oil cooler, or to circulate a cooler fluid through the oil within the axle housing. These systems have been known to work with limited success and, in most instances, are relatively complex in nature and require many extra components to attain the desired results. In addition, these systems are operational all the time and are extremely limited in their versatility.

The present invention is directed to overcoming one or more of the problems listed above.

DISCLOSURE OF THE INVENTION

In one aspect of the present invention a cooling system is provided for a machine. The cooling system includes an engine that is associated with the machine and a first cooling system that is adapted for cooling the coolant that is circulated within the engine. A heat exchanger is positioned within the first cooling system, through which the engine coolant is circulated. At least one axle assembly is mounted on the machine and a second cooling system is included for circulating oil through the axle assembly and the heat exchanger. A pump is positioned within the second cooling system for selectively circulating the oil therewithin and is adapted for driving engagement with the engine. A clutch member is positioned between the pump and the engine for selectively engaging the drive between the pump and the engine. A first sensor is adapted for engagement with the engine for sensing the temperature thereof. The first sensor is operatively connected with the clutch member to engage the clutch when the engine temperature reaches a preselected amount. A second sensor is adapted for engagement with the axle for sensing the temperature thereof. The second sensor is operatively connected with the clutch member to engage the clutch when the axle temperature reaches a preselected amount.

In another aspect of the present invention, an improvement is provided for a machine that includes an engine, a pair of axles that are drivingly connected to the engine to provide motive power to the machine and a cooling system for reducing the operating temperature of the engine. The improvement includes a heat exchanger that is positioned within the engine cooling system and a second cooling system that circulates oil through one of the axle assemblies and the heat exchanger. A third cooling system is provided for circulating oil through the other of the axle assemblies and the heat exchanger. A means is included for selectively circulating oil within the respective axles and through the heat exchanger. A means for sensing the temperature in each of the engine and axle assemblies is also included. The sensing means actuates the circulating means in response to the temperature in one of the engine and axles attaining a preselected amount.

With a cooling system as described above, a pair of sensors are associated with one or both of the axle assemblies as well as the engine coolant within the engine cooling system. When the temperature in either component reaches a predetermined amount, a pump is actuated to circulate the fluid within the axle assembly through the heat exchanger positioned within the engine's cooling system. If the temperature of the axle oil is excessive, the engine coolant will reduce the temperature of the axle oil as it passes through the heat exchanger. Conversely, if the temperature of the engine coolant is too high, the cooler axle oil will reduce the temperature thereof as it is circulated through the heat exchanger. Being so arranged, the cooling system is responsive to the mode of machine operation to provide cooling as required.

BRIEF DESCRIPTION OF THE DRAWINGS

The drawing a diagrammatic schematic of the cooling system for a machine that embodies the principles of the present invention.

BEST MODE FOR CARRYING OUT THE INVENTION

Referring now to the drawing, a cooling system 10 for a machine is shown. The machine (not shown) includes an engine 12 that is drivingly connected to a pair of axle assemblies 14 and 16 in a conventional manner that is not shown herein. The engine is also of conventional configuration an internal cooling system of conventional design.

The engine cooling system 18 includes a radiator 20 that is connected to the engine 12 in typical fashion by an upper and lower radiator hose 22 and 24 respectively that provides cooling of the engine coolant in conventional manner. A conduit 26, through which engine coolant is circulated, is added to the engine cooling system and is shown to exit the engine at an outlet port 28 and communicates fluid to a heat exchanger 30. Another conduit 32 communicates engine coolant from the heat exchanger 30 back to the engine block where it re-enters the cooling system of the engine at an inlet port 34. The heat exchanger 30 is positioned in communication with the conduits 26 and 32 in a manner wherein the engine coolant is circulated therethrough by an engine driven pump 36.

The first axle assembly 14 is of conventional configuration having differential assembly, a pair of axle shafts extending to each end portion thereof to drive a pair of wheels in a conventional manner. A plurality of brake assemblies is connected to the axle shafts to provide braking capabilities for the machine, also in a conventional manner. All of these components are housed within a common axle housing 38 and are not individually illustrated.

The first axle assembly 14 includes a second cooling system shown generally at 40. The second cooling system includes a conduit 42 that extends from an outlet port 44 on a lower portion of the axle housing 38 and communicates the oil within the axle housing to a pump 46. Another conduit 48 communicates the oil from the pump 46 to the heat exchanger 30. The oil is carried back from the heat exchanger to the axle housing via conduits 50 and 52 and enters the axle housing through a pair of inlet ports 54 and 56.

The second axle assembly 16 is substantially identical to the first axle assembly 14. The second axle assembly includes a third cooling system that is shown generally at 58. The third cooling system includes a conduit 60 that extends from an outlet port 62 that is located on a lower portion of the axle housing 64 and communicates the oil within the axle housing to the pump 46. Another conduit 66 communicates the oil from the pump 46 to the heat exchanger 30. The oil is directed back to the axle via conduits 68 and 70 and enters the axle at two inlet ports 72 and 74. It is to be noted that while the oil from both axle assemblies 14 and 16 is circulated by a common pump 46 through a common heat exchanger 30, each system is maintained separate from one another so as to eliminate the possibility of cross contamination between the two systems.

The pump 46 is driven by an electric clutch member 76. The clutch member 76 is in turn actuated by one of a pair of sensors 78 and 80. The first sensor 78 is connected to the engine 12 by a probe (not shown) that is positioned within a water jacket on the engine to sense the temperature of the engine coolant. The probe is connected to the sensor 78 by a wire 82. When the engine coolant reaches a preselected temperature, the sensor will cause a signal to be delivered to the electric clutch 76 to drive the pump 46. The second sensor 80 is also a probe-type sensor that is connected to the first axle 14 and senses the temperature of the oil within the axle assembly. The probe is connected to the sensor by a wire 84. When the oil reaches a preselected temperature, the second sensor will cause a signal to be delivered to the electric clutch to drive the pump. It is to be understood that either sensor may actuate the pump in response to the temperature of the engine coolant or the axle oil and act entirely independent of one another.

Industrial Applicability

During the operation of a construction machine such as a wheel loader, it is common for the machine to operate in one of several possible modes. In one common mode, the machine may be utilized for loading a truck, doing backfill work or some other operation wherein there is not much movement of the machine but there is high engine usage to operate the various implements. In this mode of operation, the temperature of the engine coolant is likely to become elevated over a period of time. In the event that it reaches a preselected temperature, which in the instant application is approximately 98° C., the first sensor will be activated and the electric clutch 76 will be engaged to provide drive from the engine 12 to the pump 46. The pump will then circulate the oil from within the axle housings 38 and 64 through the heat exchanger 30. Since the machine is operating in a mode wherein there is not much movement and thereby not much braking, the oil within each axle housing is much cooler than the engine coolant. Since both the engine coolant and the oil from the axle assemblies are circulated within the same heat exchanger, the temperature of the engine coolant is reduced. When the temperature of the engine coolant reaches approximately 95° C., the first sensor 78 will send a signal to the clutch to disengage the drive between the engine and the pump.

In other modes of operation, such as load and carry, the machine is utilized to carry material from one site to another. During this movement, the machine is typically operated at its upper ranges of speed. When the desired destination is reached, a large amount of braking capacity is required to slow and stop the machine. This of course causes the oil within the respective axle housings 38 and 64 to become heated by the brake assemblies also housed therewithin. When the oil temperature reaches a predetermined degree, which in the present instance is approximately 65° C., the second sensor 80 is actuated, thereby causing engagement of the electric clutch 76. As previously set forth, the clutch will in turn connect the drive between the engine 12 and the pump 46 to circulate the oil from each axle assembly 14 and 16 through the heat exchanger 30. Since the engine coolant is cooler during this mode of operation than the axle oil, the temperature of the axle oil is reduced as it is circulated through the heat exchanger. When the axle oil reaches a temperature of approximately 57° C., the drive to the pump 46 is disengaged by the clutch 76.

With this cooling system, excessive wear and possible premature failure of various machine components is greatly reduced by providing additional cooling capacity for both the engine and the axle assemblies. Further, the additional cooling may be attained automatically depending upon the mode of operation in which the machine is engaged.

Other aspects, objects and advantages of this invention can be obtained from a study of the drawings, the disclosure and the appended claims.

What is claimed is:

1. A cooling system for a machine, comprising:

an engine operatively associated with the machine;

a first cooling system adapted for circulating engine coolant through the engine;

a heat hanger positioned within the first cooling system for the communication of engine coolant therethrough;

at least one axle assembly mounted on the machine;

a second cooling system adapted for circulating oil through the axle assembly and through the heat exchanger;

a pump positioned within the second cooling system for selectively circulating the oil, said pump being adapted for driving engagement with the engine;

a clutch member positioned between the pump and the engine for selectively engaging the drive between the pump and the engine;

a sensor adapted for engagement with the engine for sensing the temperature thereof and being operatively connected with the clutch member to engage the clutch when the engine temperature reaches a preselected amount; and a second sensor adapted for engagement with the axle for sensing the temperature thereof and being operatively connected with the clutch member to engage the clutch when the axle temperature reaches a preselected amount.

2. The cooling system as set forth in claim 1 wherein a second axle assembly is mounted on the machine, said second axle being communicated with a third cooling system that is adapted to circulate oil through the second axle assembly.

3. The cooling system as set forth in claim 2 wherein the third cooling system includes a pump for circulating oil through the heat exchanger, said pump being operatively engaged with the engine and the clutch member.

4. The cooling system as set forth in claim 1 wherein the oil of the third cooling system is circulated through the heat exchanger in a manner wherein it is not communicated with the oil in the second cooling system.

5. The cooling system as set forth in claim 1 wherein the heat exchanger is a oil to water heat exchanger.

6. The cooling system as set forth in claim 5 wherein a radiator is positioned in the first cooling system, said radiator being adapted to function as an air to water heat exchanger.

7. The cooling system as set forth in claim 1 wherein the axle assembly includes a plurality of brake elements that are positioned in communication with the second cooling system.

8. The cooling system as set forth in claim 1 wherein the first sensor senses the temperature of the engine coolant within the first cooling system and the second sensor senses the temperature of the oil within the second cooling system.

9. In a machine having an engine, a pair of axles drivingly connected to the engine to provide motive power to the machine and a cooling system for reducing the operating temperature of the engine, the improvement comprising:

a heat exchanger positioned within the engine cooling system;

a second cooling system for circulating oil through one of the axle assemblies and the heat exchanger;

a third cooling system for circulating oil through the other of the axle assemblies and the heat exchanger;

means for selectively circulating oil within the respective axles and through the heat exchanger; and means for sensing the temperature in each of the engine or axle assemblies and actuating the circulating means in response to the temperature in one of the engine or axles attaining a preselected amount.

10. The improvement as set forth in claim 9 wherein the second and third cooling systems are separate systems that do not communicate with one another.

11. The improvement as set forth in claim 9 wherein the circulating means further includes:

a pump for circulating oil through the respective axle assemblies, said pump being drivingly connected to the engine.

12. The improvement as set forth in claim 11 wherein a clutch member is interposed between the pump and the engine to selectively engage the pump with the engine.

13. The improvement as set forth in claim 12 wherein the sensing means includes a first sensor that is adapted for engagement with the engine to sense the temperature thereof, said first sensor being operatively engaged with the clutch member to selectively engage the clutch member to provide driving engagement between the pump and the engine in response to the engine temperature reaching a preselected amount.

14. The improvement as set forth in claim 12 wherein the sensing means includes a second sensor that is adapted for engagement with at least one of the axles to sense the temperature thereof, said second sensor being operatively engaged with the clutch member to provide driving engagement between the pump and the engine in response to the temperature of the said axle reaching a preselected amount.

15. The improvement as set forth in claim 14 wherein the sensing means operates in a first condition wherein the first sensor engages the clutch member and the pump circulates oil from within the axle through the heat exchanger to reduce the temperature of the engine coolant within the engine cooling system and a second condition wherein the second sensor engages the clutch member and the pump circulates oil from within the axle through the heat exchanger to reduce the temperature of the axle oil.

* * * * *